US008283588B2

(12) United States Patent
Norris et al.

(10) Patent No.: US 8,283,588 B2
(45) Date of Patent: Oct. 9, 2012

(54) METHOD AND SYSTEM FOR SORTING POSTAL MAIL

(75) Inventors: Michael O. Norris, Colleyville, TX (US); James B. Amigh, Plano, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 758 days.

(21) Appl. No.: 11/786,839

(22) Filed: Apr. 13, 2007

(65) Prior Publication Data

US 2008/0251429 A1 Oct. 16, 2008

(51) Int. Cl.
*B07C 5/00* (2006.01)

(52) U.S. Cl. ..... 209/586; 209/592

(58) Field of Classification Search ..... 209/583, 209/584, 900, 586, 592, 645, 659; 700/223–227
See application file for complete search history.

(56) References Cited

U.S. PATENT DOCUMENTS

| | | | | |
|---|---|---|---|---|
| 3,916,695 | A | 11/1975 | Branecky | 73/432 |
| 5,901,855 | A * | 5/1999 | Uno et al. | 209/584 |
| 6,032,517 | A | 3/2000 | Resig et al. | 73/78 |
| 6,557,755 | B1 | 5/2003 | Pickering, Jr. et al. | 235/376 |
| 6,655,683 | B2 | 12/2003 | Engarto et al. | 271/265 |
| 7,162,459 | B2 | 1/2007 | Massucci et al. | 705/401 |
| 7,315,007 | B2 * | 1/2008 | Redford et al. | 209/584 |
| 7,507,930 | B2 * | 3/2009 | Carey et al. | 209/584 |
| 2002/0040283 | A1 | 4/2002 | Woods et al. | 702/189 |
| 2004/0040283 | A1 | 3/2004 | Yasui et al. | 60/276 |
| 2004/0245158 | A1 * | 12/2004 | Redford et al. | 209/584 |
| 2005/0279674 | A1 * | 12/2005 | Gillet | 209/584 |
| 2005/0280833 | A1 * | 12/2005 | Dian et al. | 356/630 |

* cited by examiner

*Primary Examiner* — Joseph C Rodriguez
*Assistant Examiner* — Kalyanavenkateshware Kumar

(57) ABSTRACT

A process is provided for analyzing the physical characteristics of flat articles being sorted to determine which downstream operations the articles should be processed with next. Length, height, width and stiffness information are received from sensors, and the data is analyzed to determine if the mail piece is automation compatible, extended capability or manual letter, or a flat.

19 Claims, 5 Drawing Sheets

METHOD AND SYSTEM FOR SORTING POSTAL MAIL

BACKGROUND

For years, the United States Postal Service has been sorting letter mail using automation equipment. The size of mail sorted on this equipment is limited to specification listed in the Domestic Mail Manual (DMM Chapter 101, pars. 1.2, 1.3) and generally meets the defined criteria, namely that the mail piece is rectangular and:

(a) not less than 5 inches long, 3½ inches high, and 0.007-inch thick;

(b) not more than 11½ inches long, or more than 6⅛ inches high, or greater than ¼-inch thick;

(c) if more than 4¼ inches high or 6 inches long, the thickness is not less than 0.009 inch;

(d) weight is not more than 3.3 ounces; and (e) aspect ratio is from 1.3 to 2.5.

In the past, mail that was outside these specifications was sent to costly manual sorting operations. Recently, the USPS has deployed equipment which is capable of sorting mail up to 0.5 inches thick and can weigh up to 6.0 ounces. Mail which fits the increased standard is categorized as Expanded Capability (EC) mail and is sorted on a Delivery Bar Code Sorter Input/Output Sub-System (DIOSS EC) machine manufactured by Siemens Postal Automation. EC mail is sorted in a separate operation from the automation compatible mail.

At present, EC mail is only sorted to the Delivery Unit (DU). At the DU, the EC mail along with the residual manual mail is manually sorted to carrier route by a clerk, and then cased to delivery point sequence by a letter carrier. Compared to automation mail, manual mail is costly to sort. In contrast, automation compatible mail can be sorted to a finer sort depth, using multiple automated processes, to a Delivery Point Sequence (DPS) using efficient automation equipment, thus eliminating costly manual casing operations.

"Manual mail" for purposes of the invention is a relative term and depends on the nature of the automation equipment in use at a specific facility, i.e., an item is manual mail if it cannot be processed by that equipment. There are two general categories of manual mail. The first is classified as non-machinable due to its physical characteristics. Non-machinable mail includes, but is not limited to, mail that is too large, too small, too flimsy, too rigid, not rectangular in nature, unsealed bi-folds and tri-folds, loose bound edge booklets and pamphlets, loose plastic packed, and mail with items inserted within it such as pens, jewelry, coins and etc. The second category is referred to as "non readable". This mail is typically considered mail which cannot be read by an Optical Character Reader (OCR) or video coding, or has an obscured address or bar code, or incorrect address information.

The determination of whether letter mail is sent to a manual operation, automation operation or EC operation is presently performed by a human and is subjective. The postal service pays a financial penalty for allowing a human to decide what type of mail is to be processed by which operation. First, good automation mail sometimes gets mixed with mail that is sent to the EC operation. From this point on, the automation mail is mixed with the EC mail and is sorted manually in the downstream processes. Second, good automation mail is sometimes sent to a manual operation and has to be sorted manually.

This invention provides an alternate method for distinguishing automation mail from EC and manual mail which has typically considered manual non machinable in the first category, due to its physical characteristics. The invention provides a method for identifying mail, which includes automation mail that can be processed automatically by automated machines, EC mail, which can be processed automatically using EC machines and manual mail which, due to its physical characteristics, cannot be processed by the automated machines or EC machines at the sorting facility.

SUMMARY OF THE INVENTION

The invention provides a process for sorting mail into groups based on predefined sets of physical attributes, such as those for automation mail and EC mail discussed above, and other standards which may be prescribed in the future. The first group has a first set of physical attributes such that mail pieces of the first group can be sorted by a first type of postal automated sorting machine. The second group has a second set of physical attributes such that mail pieces of the second group can be sorted by a second type of postal automated sorting machine, which second automated sorting machine has extended capability in comparison to the first automated sorting machine such that it can sort mail pieces having certain attributes outside of one or more of the first set of physical attributes. The third group comprises mail pieces that fail to meet either of the first and second sets of physical attributes. It should be noted that the process could be used in connection with three or more different sets of sorting standards, in which case the last group will consist of "reject" mail pieces that fail to meet any of the sets of physical attributes of the previously defined groups.

The process includes the steps of feeding a series of singulated mail pieces into a conveyor system, measuring physical attributes of each mail piece as it is being conveyed on the conveyor system, analyzing the measured physical attributes of each mail piece to determine if it meets the first and second sets of attributes, segregating mail pieces of the third group from the mail pieces that meet either the first or second sets of attributes, and segregating mail pieces that meet the first set of attributes from mail pieces that meet the second set of attributes but do not meet the first set of physical attributes. In the case of automation mail and EC mail using the standards discussed above, the first set of physical attributes are a subset of the second set of physical attributes. The physical attributes analyzed preferably include mail piece dimensions and weight. Other characteristics such as stiffness and the presence of an object inside the mail piece are preferably also considered as discussed further below.

The foregoing process may be carried out using an apparatus according to the invention which determines if a flat mail piece is non-machinable, may be processed using standard automation equipment, or may be processed using equipment with extended capability, which apparatus may be incorporated along a conveyor system of a postal sorting machine. Such an apparatus includes a series of sensors positionable along the conveyor system for measurement of physical attributes of individual mail pieces traveling on the conveyor, and an electronic analyzer configured to receive measurement signals from the sensors and programmed with predetermined criteria for sorting mail into groups as described above. The invention further provides a postal sorting machine in which such an apparatus has been installed, and a sensor array system including a matrix of proximity sensors positioned to develop a thickness profile of a passing mail piece. These and other aspects of the invention are discussed further in the detailed description that follows.

BRIEF DESCRIPTION OF THE DRAWINGS

In the accompanying drawings, wherein like numerals denote like elements.

DETAILED DESCRIPTION

A process according to one embodiment of the invention analyzes the physical characteristics of flat articles such as mail pieces being sorted to determine which downstream operations the articles should be processed with next. Length, height, width and stiffness information are received from sensors, and the data is analyzed to determine if the mail piece is automation compatible, extended capability or manual letter, or a flat.

Figure 1:
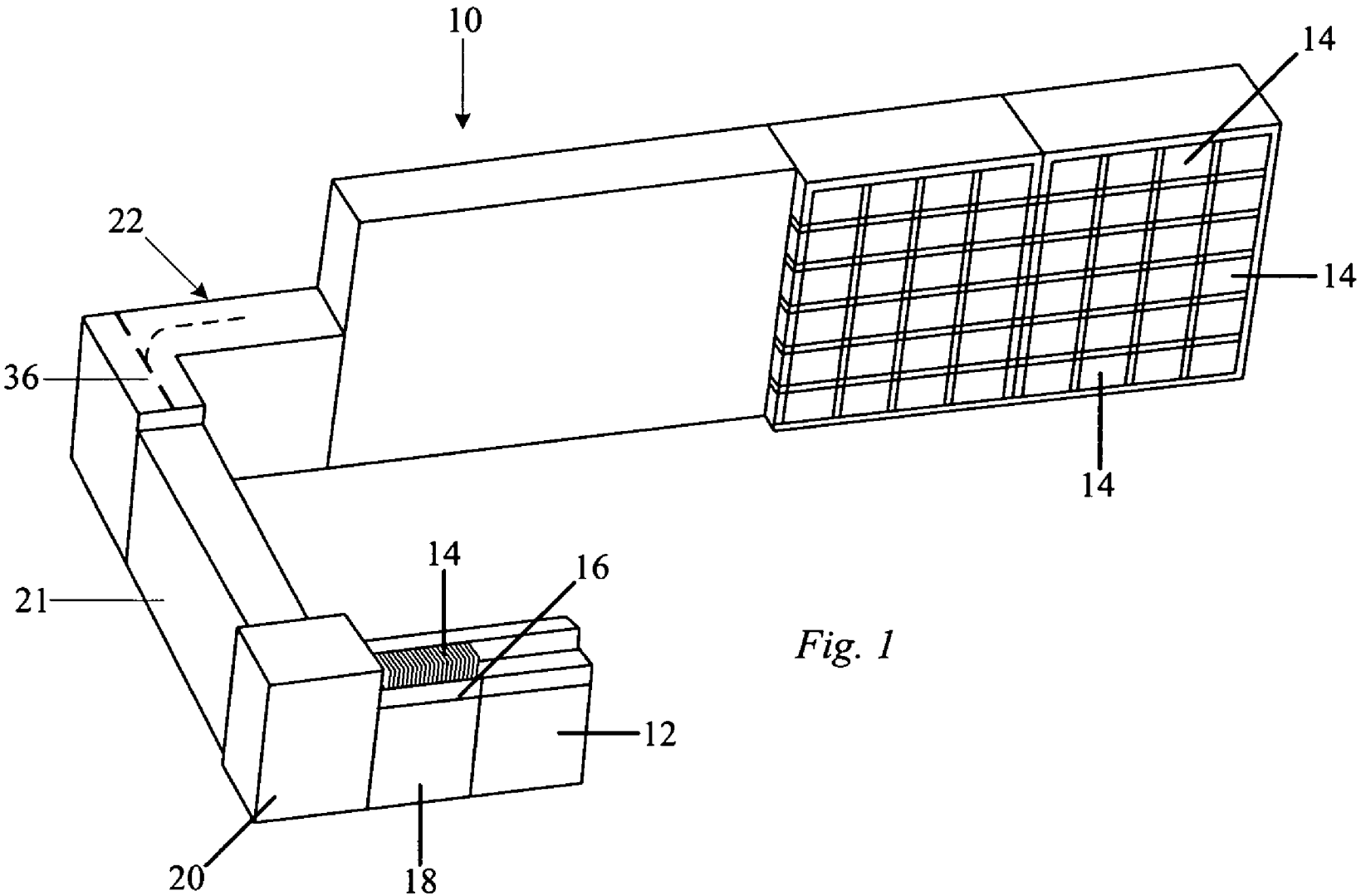
FIG. 1 is a perspective view of a DIOSS-EC machine used in the invention.

An analyzer and process according to the invention can be used in a mail processing machine such as a DIOSS EC machine 10 as shown schematically in FIG. 1. Such a machine includes an EC mail feeder 12 upon which a stack 14 of unsorted mail pieces 16 are loaded for processing. Mail feeder 12 has a jogger-conveyor 18 that advances the stack 14 to a pick off apparatus 20. Pickoff 20 feeds a singulated stream of mail pieces through a transport section 21 to an automated sorting section 22 which sorts the mail in one or more passes to a plurality of pockets or bins 24. In transport section 21, each mail piece is scanned for address information. Sorting section 22 is limited in terms of the thickness, stiffness and combined thickness and stiffness of mail pieces that it can process.

Figure 2:
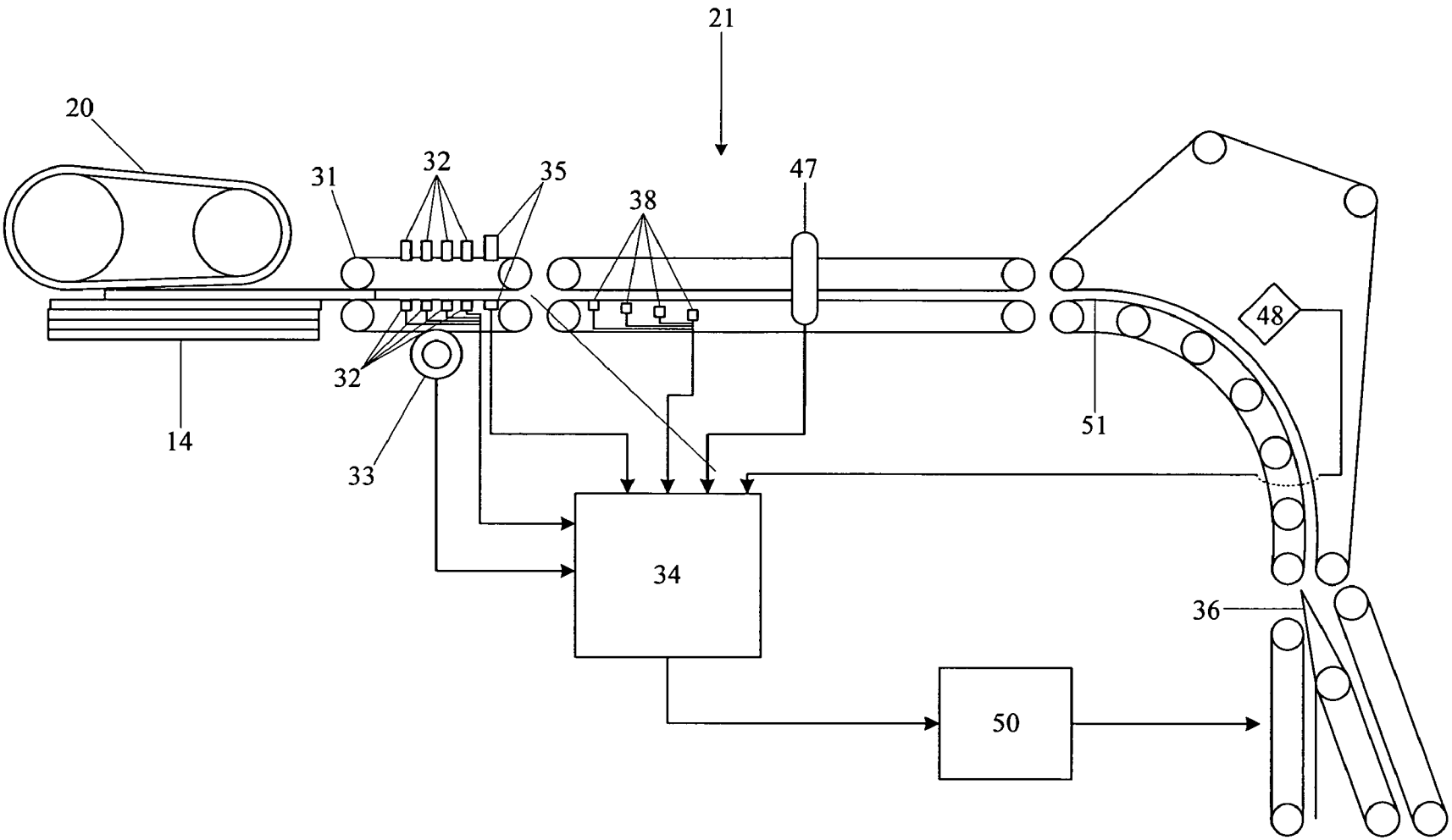
FIG. 2 is a schematic diagram of an apparatus according to the invention.
Figure 3:
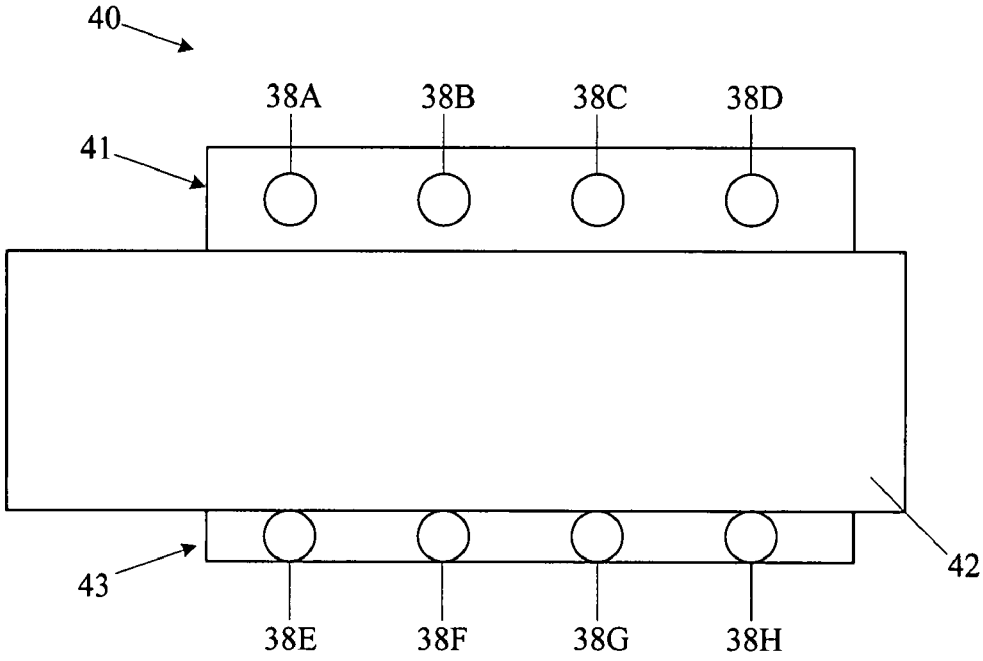
FIG. 3 is a side view of the sensor array of FIG. 2.

Referring to FIG. 2, a mail piece 16 is separated and singulated from the mail stack 14 by the pick-off belts of the pickoff 20. Mail with a width greater than the gap limits of the pinch rollers 31 of the transport section 21 cannot enter the mail path and must be removed by an operator. Mail with a width less than the gap limits of the pinch rollers is pinched and inducted into the mail path.

The mail piece is transported past a series of light barriers 32 each comprising a photocell receiver element and a light emitter on opposite sides of the conveyor and aligned in parallel to the base plate of the conveyor system. Barriers 32 are used to determine the mail length and the gap between successive mail pieces. A tachometer 33 is positioned to monitor the belt speed of the conveyor as the mail passes light barriers 32. A physical attribute analyzer 34 according to the invention, which may be a microprocessor, circuit, or computer, receives a high resolution signal from a tachometer 34 and the duration of the block conditions of light barriers (4) to calculate the length of each passing mail piece and the gap between successive mail pieces. Barriers 32 are spaced along the length of the conveyor path as shown so that both length and gap can be determined in a manner known in the art. Mail pieces that are determined to be too long or which have too small a gap (represent a double with the mail piece ahead of it) are directed out of the machine by a diverter gate 36. A height detection light barrier 35 is provided above the level of the conveyor belts to detect a mail piece that is too tall and therefore must be diverted and handled as manual mail. If weight estimation based on dimensions will be used as discussed below, then a vertical row of barriers 35 or an imaging system can be provided to measure the height of each mail piece.

As the mail piece is transported further downstream in the conveyor path, it passes a series of detection sensors 38. The detection sensors 38 are a series of proximity switches arranged in a matrix 40. The sensors are adjusted and/or spaced to trigger at different depths. As a mail piece passes the sensors, switches are either triggered by the mail piece or not. The physical attribute analyzer 34 monitors the on-off state of the sensors in the matrix and builds a table for each mail piece. The table is a mathematical representation of the thickness profile of each mail piece. Mail pieces which are determined to have a non-planar surface indicating there might be an object inserted in the mailpiece such as a pen or coin are directed out of the machine by the diverter gate 36. Mail pieces with foreign objects inside are considered non-machinable according to postal standards and need to be diverted out of the machine.

FIGS. 3-6 illustrate an example of sensor matrix 40. Sensors 38 are arranged in two or more horizontal rows along the conveyor path, including a first row 41 above the conveyor belts 42 and a second row 43 below belts 42. In this example, sensors 38A-H each have a detection range R but are set at varying distances from the conveyor path. If sensors with adjustable range are used, then the sensors could be set in a line at the same distance from the conveyor path. Sensors 38 may be of the optic type which project a beam onto the surface of the passing mail piece and then judge the distance from the strength of the reflection, but any type of known proximity sensor usable for moving mail can be used.

Figure 4:
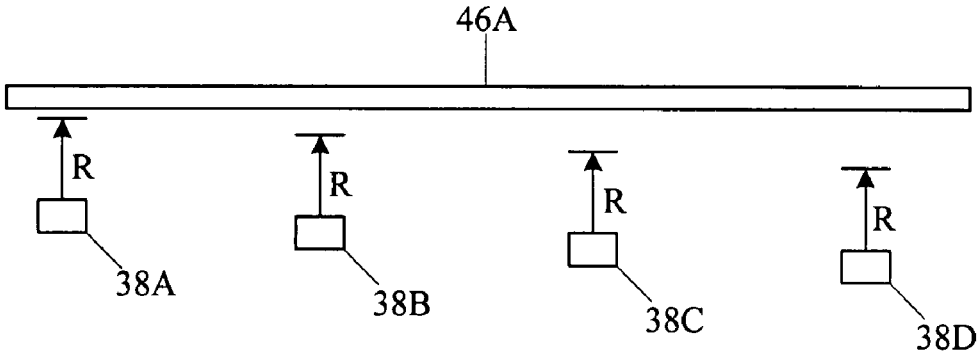
FIGS. 4-6 are top views of mail pieces of different thicknesses passing the sensor array of FIG. 3.

In FIG. 4, a thin mail piece 46A passes by. Thin mail piece 46A does not come within distance R of any of the sensors 38 in either the upper or lower rows, and hence no signals indicating a possible foreign object or thick mail piece are generated to analyzer 34. A table of values such as the following can be generated by analyzer 34:

TABLE 1

| | |
|---|---|
| lead edge reaches 38A | 0000 |
| lead edge reaches 38B | 0000 |
| lead edge reaches 38C | 0000 |
| lead edge reaches 38D | 0000 (FIG. 4) |
| trailing edge reaches 38B | 0000 |
| trailing edge reaches 38C | 0000 |
| trailing edge reaches 38D | 0000 |

Figure 5:
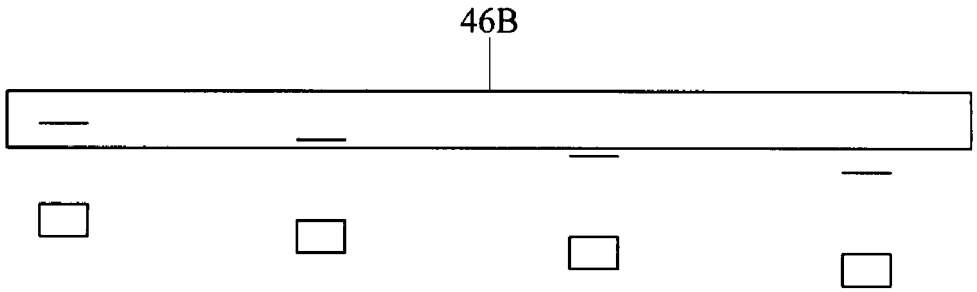

In FIG. 5, the mail piece has a uniform thickness and is thick enough to trigger the first two switches:

TABLE 2

| | |
|---|---|
| lead edge reaches 38A | 1000 |
| lead edge reaches 38B | 1100 |
| lead edge reaches 38C | 1100 |
| lead edge reaches 38D | 1100 (FIG. 5) |
| trailing edge reaches 38B | 0100 |
| trailing edge reaches 38C | 0000 |
| trailing edge reaches 38D | 0000 |

Figure 6:
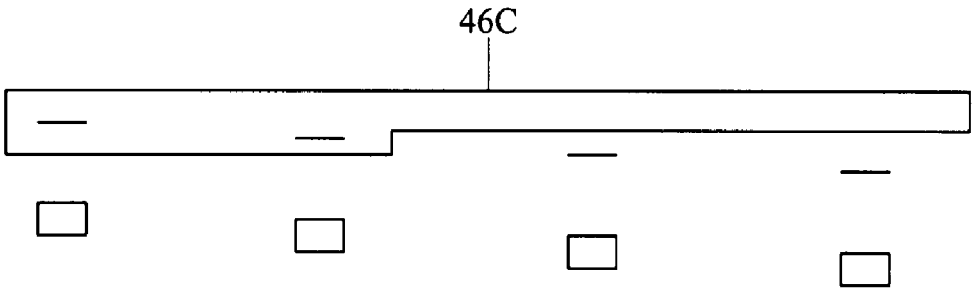

In FIG. 6, the mail piece has an object inside that makes it wider at its trailing end:

TABLE 3

| | |
|---|---|
| lead edge reaches 38A | 0000 |
| lead edge reaches 38B | 0000 |
| lead edge reaches 38C | 1000 |

TABLE 3-continued

| | |
|---|---|
| lead edge reaches 38D | 1100 (FIG. 6) |
| trailing edge reaches 38B | 0100 |
| trailing edge reaches 38C | 0000 |
| trailing edge reaches 38D | 0000 |

Similar tables are generated from the output of the other row(s) of sensor 38E-H. in order to develop a three-dimensional thickness profile of the mail piece. If the bottom row of sensors detects a mail piece with a thick portion but the upper row does not, it may indicate a small object that has settled to the bottom of the envelope. Analyzer 34 applies decision criteria such as this in deciding whether the profile generated for the mail piece is acceptable or unacceptable for the EC sorting machine. If it makes a decision to reject based on overall thickness or a profile suggesting a hard object, a signal is sent to machine control 50 (generally a computer), and that mail piece is diverted at gate 36.

The mail piece 16 next passes a thickness measuring device 47. Mail pieces determined to be too thick are diverted out of the machine by means of analyzer 34, gate 36 and machine control 50 as described above. If sensors 38 are capable of measuring actual thickness rather than just an off-on state based on proximity, then device 47 could be omitted.

As it continues to travel downstream, the mail piece 16 also passes a stiffness detector 48. In a preferred embodiment, the mail piece will be transported around a roller arrangement and the deflection of an outer pinch belt 51 will be measured by the stiffness detector 48. Items determined to be too stiff will be diverted out of the machine by the diverter gate 36.

Once all the sensor data has been collected for a single mail piece, and assuming no single attribute has caused the mail piece to be rejected and diverted as described above, the algorithms implemented in physical attribute analyzer 34 determine if the item can be processed as automation mail, or is EC mail. This information is passed to the machine control 50. Machine control 50 uses the destination information on the face of the item or the ID tag on its rear side, along with the determination of whether a piece is automation mail or EC mail, to determine what destination pocket to send the mail piece. Automation mail is segregated from the EC mail.

Figure 7:
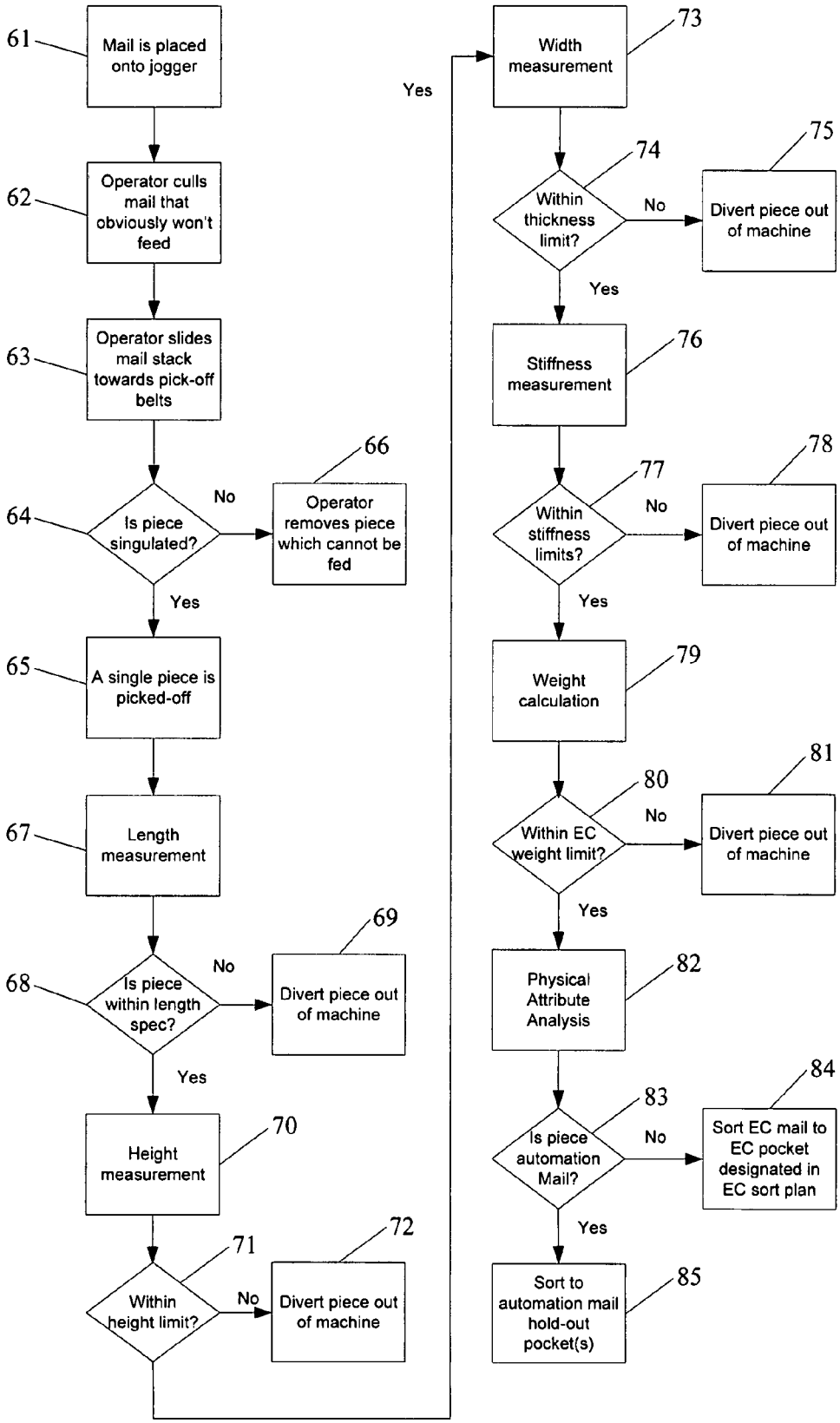
FIG. 7 is a flow diagram of a process according to the invention.

FIG. 7 illustrates a process according to one example of the invention. Except where logically required, it is not essential to perform the measurements and other steps in the order described. In a first step (61), mail 16 is placed on the jogger 18 to align the edges, and the operator culls the mail which is well beyond the EC mail spectrum (step 62). The stack of mail 14 is moved toward the pick-off belts (step 63). If the pickoff is successful (decision 64), the single piece is conveyed away along the conveyor path (step 65). If not, the operator removes the mail piece that will not feed (step 66).

The length of the mail piece is then measured optionally along with its spacing (gap) from the mail piece ahead of it (step 67). If either the length or gap are not acceptable (decision 68), the mail piece is diverted at divert gate 36 (step 69). Similarly, the height of the mail piece is measured (step 70) and if the mail piece is not within the required height limit (decision 71), it is diverted out of the machine (step 72). The width is measured using thickness measuring device 47 (step 73), and if the mail piece is not within the required thickness limit (decision 74), it is diverted out of the machine (step 75). The same logic is used for stiffness in steps 76-78 as the mail piece passes through the stiffness detector 48.

As to steps 79-81, it is necessary to reject a mail piece that is over the weight limit for EC mail. The weight of the mail piece may be determined either by direct measurement, or by estimation. Gerstenberg et al. U.S. Pat. No. 6,861,592, the contents of which are incorporated by reference herein, describes one form of weighing module for use on mail pieces moving along a conveyor path, and such a weighing module may be used in the present invention. In the alternative, it may be acceptable to calculate the estimated weight of each mail piece using a volumetric calculation. In this embodiment, analyzer 34 uses the dimensions (length, width, height) and the average density of paper mail to calculate the estimated weight. This could be implemented as a lookup table of common mail piece dimensions cross referenced with the average weight of a mail piece having those dimensions: for example, five sheets folded in three sections inserted into a #10 envelope produce an ⅛ inch envelope weighing 1.0 ounce, ten sheets folded in three sections inserted into a #10 envelope produce an ⅜ inch envelope weighing 1.9 ounces, and so on. For purposes of the invention, only a yes/no decision is needed at this stage as to whether the mail piece is over 6 ounces. The accuracy of the result need only be sufficient for this purpose.

If a mail piece reaches this point without being diverted, it has survived the first stage of the process which determines whether the mail piece is machinable either as EC or automation mail. In step 82, the physical attribute analyzer then analyzes the measured characteristics to determine if the mail piece is automation mail (decision 83). If it is automation mail, it is sorted to automation mail hold out pockets (step 84). If not, then it is EC mail and is sorted to an EC pocket according to an EC sort plan (step 85). The analysis step (82) involves two sub-steps. As noted above, EC mail can have greater weight and thickness than regular automation mail. Analyzer 34 receives a signal from thickness measuring device 47 which indicates the thickness parameter. It also determines the approximate weight of the mail piece by one of the methods noted above to determine if the weight is 3.3 ounces or less.

Mail rejected out of the equipment in the various divert steps is combined with the operator culls (step 62) and sent to a manual sorting/casing area. Mail in the pockets designated for automation mail is trayed and transferred to machines running automation mail schemes. Mail in the pockets designated for EC mail is transferred to the delivery unit. A majority of the DIOSS-EC sorting bins are used to sort the EC mail according to the predetermined sort scheme, generally to the delivery unit level, whereas a limited number of hold-out bins or pockets are reserved for the automation mail. However, the method of the invention could be practiced as a stand-alone operation to segregate EC mail, automation mail and manual mail without any level of concurrent sorting. A typical EC sort plan would have 120 pockets for outbound destinations (outside the local area, ADC, AADC network), 60 pockets for inbound destinations (30 or 40 DU's and the rest large volume local hold-outs), and 16 to 20 exception pockets for PARS (redirected mail to be forwarded) and different types of rejects. Automation mail segregated according to the invention would be sent to one or more of the pockets reserved for rejects in the last group. With an average run of 100,000 mail pieces and a 7% automation rate, there would be 7,000 mail pieces or an average of 10 trays of automation mail per run. Under these conditions, four or five pockets would receive the automation mail.

The invention as described in the foregoing example uses a Format Control Unit (FCU) that prevents non-machinable mail pieces from entering the sorting system and potentially causing a jam or misfeed. Many of these FCU components have been used in prior mail processing processes. The length and height detection logic is well know to those skilled in the art of mail processing and is incorporated into thousands of machines deployed at the USPS and commercially. In addition, the FCU includes a width and stiffness detection measurement system similar to that described in Reisig et al. U.S. Pat. No. 6,032,517 which is incorporated by reference herein. In particular, a laser distance sensor as described in Reisig et al. may be used as thickness sensor 47 in the present invention. The width (thickness) of the mail piece can be measured as described in U.S. Patent Publication 20050280833 (Solystic), Engarto et al. U.S. Pat. No. 6,655,683, or by other means known to persons skilled in the art. Stiffness of the mail piece may be measured using the concepts presented in commonly assigned Redford et al. U.S. Patent Application 20040245158, Dec. 9, 2004, the contents of which are incorporated by reference herein, or by other means known to persons skilled in the art.

The above description describes one implementation of the invention. Other embodiments include the sensors configured in different order and may include the addition of sensors not mentioned in the description. For example, one embodiment might include a sensor which detects ferrous material or a biohazardous material, and the process would call for diverting mail pieces containing such materials. Regarding the automation mail standards set forth in the DMM, these values are merely representative of a current specification and are likely to be modified in the future. The applicability of the invention is not limited to the DMM specification discussed above. The analyzer and/or the sorter control system may be programmable so that the criteria can be changed on an existing machine in the event that different physical characteristics are adopted by the postal agency. The analyzer may be incorporated into the overall sorter control computer or may be a separate device as described in the example above. These and other variations and additions are specifically contemplated to be with the scope of the invention. It is intended that the appended claims encompass any such modifications or embodiments.

The invention claimed is:

1. A method for sorting mail into groups based on predefined sets of physical attributes, wherein a first group has a first set of physical attributes such that mail pieces of the first group can be sorted by a first type of postal automated sorting machine, a second group has a second set of physical attributes such that mail pieces of the second group can be sorted by a second type of postal automated sorting machine, which second automated sorting machine has extended capability in comparison to the first automated sorting machine such that it can sort mail pieces having certain attributes outside of one or more of the first set of physical attributes, and a third group comprises mail pieces that fail to meet either of the first and second sets of physical attributes, comprising:

feeding a series of singulated mail pieces into a conveyor system;

measuring physical attributes of each mail piece as it is being conveyed on the conveyor system;

analyzing the measured physical attributes of each mail piece to determine if it meets the first and second sets of physical attributes;

segregating mail pieces of the third group from the mail pieces that meet either the first or second sets of physical attributes, wherein measuring the mail pieces of the third group is performed using successive steps of measuring length, height, width, stiffness, and weight, and the mail pieces of the third group are selectively diverted according to the measurements; and segregating mail pieces that meet the first set of physical attributes from mail pieces that meet the second set of physical attributes but do not meet the first set of physical attributes.

2. The method of claim 1, wherein the first set of physical attributes are a subset of the second set of physical attributes.

3. A method for sorting mail into groups based on predefined sets of physical attributes, wherein a first group has a first set of physical attributes such that mail pieces of the first group can be sorted by a first type of postal automated sorting machine, a second group has a second set of physical attributes such that mail pieces of the second group can be sorted by a second type of postal automated sorting machine, which second automated sorting machine has extended capability in comparison to the first automated sorting machine such that it can sort mail pieces having certain attributes outside of one or more of the first set of physical attributes, and a third group comprises mail pieces that fail to meet either of the first and second sets of physical attributes, comprising:

feeding a series of singulated mail pieces into a conveyor system;

measuring physical attributes of each mail piece as it is being conveyed on the conveyor system:

analyzing the measured physical attributes of each mail piece to determine if it meets the first and second sets of physical attributes;

segregating mail pieces of the third group from the mail pieces that meet either the first or second sets of physical attributes, wherein measuring the mail pieces of the third group is performed using successive steps of measuring length, height, width, stiffness, and weight, and the mail pieces of the third group are selectively diverted according to the measurements; and segregating mail pieces that meet the first set of physical attributes from mail pieces that meet the second set of physical attributes but do not meet the first set of physical attributes;

wherein the first set of physical attributes comprises that the mail piece is rectangular and: (a) not less than 5 inches long, 3½ inches high, and 0.007-inch thick; (b) not more than 11½ inches long, or more than 6⅛ inches high, or greater than ¼-inch thick; (c) if more than 4¼ inches high or 6 inches long, the thickness is not less than 0.009 inch; (d) weight is not more than 3.3 ounces; and (e) aspect ratio is from 1.3 to 2.5.

4. The method of claim 3, wherein the second set of physical attributes is the same as the first set except that: (a) the thickness may be up to 0.5 inch; and (b) the weight may be up to 6.0 ounces.

5. The method of claim 1, wherein the process is carried out on a mail sorting machine wherein the conveyor system comprises a pair of upright pinch belts, and the step of measuring physical attributes of each mail piece comprises using sensors to automatically measure selected physical attributes of each mail piece as it is conveyed past each sensor.

6. The method of claim 5, wherein the sensors include light barriers positioned to detect mail piece length and height and a thickness sensor positioned to detect mail piece thickness.

7. The method of claim 1, wherein the process is carried out on a postal sorting machine, and further comprises:

scanning each mail piece to determine destination address information for each mail piece; and sorting mail pieces of the second group to preassigned bins of the sorting machine based on the scanned address information.

8. The method of claim 7, further comprising sorting mail pieces of the first group to one or more preassigned bins of the sorting machine without using the scanned address information.

9. A method for sorting mail into groups based on predefined sets of physical attributes, wherein a first group has a first set of physical attributes such that mail pieces of the first group can be sorted by a first type of postal automated sorting machine, a second group has a second set of physical attributes such that mail pieces of the second group can be sorted by a second type of postal automated sorting machine, which second automated sorting machine has extended capability in comparison to the first automated sorting machine such that it can sort mail pieces having certain attributes outside of one or more of the first set of physical attributes, and a third group comprises mail pieces that fail to meet either of the first and second sets of physical attributes, comprising:

feeding a series of singulated mail pieces into a conveyor system;

measuring physical attributes of each mail piece as it is being conveyed on the conveyor system using a plurality of detection sensors arranged in a matrix;

analyzing the measured physical attributes of each mail piece to determine if it meets the first and second sets of physical attributes;

segregating mail pieces of the third group from the mail pieces that meet either the first or second sets of physical attributes; and segregating mail pieces that meet the first set of physical attributes from mail pieces that meet the second set of physical attributes but do not meet the first set of physical attributes, wherein segregating is performed using measurements obtained by successive steps of measuring length, height, width, stiffness, and weight.

10. The method of claim 9, wherein the first set of physical attributes are a subset of the second set of physical attributes.

11. The method of claim 9, wherein the detection sensors are disposed above and below the conveyor.

12. The method of claim 9, wherein the detection sensors are proximity switches spaced to trigger at different depths in relation to the conveyor.

13. The method of claim 9, wherein the detection sensors have a substantially same detection range and are set at varying distances from the conveyor path.

14. The method of claim 9, wherein the detection sensors have adjustable detection ranges and are set at a substantially same distance from the conveyor path.

15. The method of claim 9, wherein the detection sensors are optical sensors.

16. The method of claim 9, further comprising generating a table of values indicative of a mathematical representation of a thickness profile of each mail piece.

17. The method of claim 3, wherein the first set of physical attributes are a subset of the second set of physical attributes.

18. The method of claim 1, wherein segregating mail pieces that meet the first set of physical attributes from mail pieces that meet the second set of physical attributes but do not meet the first set of physical attributes is performed using measurements obtained by successive steps of measuring length, height, width, stiffness, and weight.

19. The method of claim 3, wherein segregating mail pieces that meet the first set of physical attributes from mail pieces that meet the second set of physical attributes but do not meet the first set of physical attributes is performed using measurements obtained by successive steps of measuring length, height, width, stiffness, and weight.

* * * * *